United States Patent [19]

Leemann et al.

[11] 4,453,077

[45] Jun. 5, 1984

[54] LIQUID-FILM ELECTRON STRIPPER

[75] Inventors: Beat T. Leemann, Walnut Creek; Roland B. Yourd, Kensington, both of Calif.

[73] Assignee: The United States of America as represented by the United States Department of Energy, Washington, D.C.

[21] Appl. No.: 356,581

[22] Filed: Mar. 9, 1982

[51] Int. Cl.[3] ..... H01J 3/04

[52] U.S. Cl. ..... 250/423 R; 239/703

[58] Field of Search ..... 250/423; 239/214, 222.11, 239/224

[56] References Cited

U.S. PATENT DOCUMENTS

| | | | |
|---|---|---|---|
| 3,083,911 | 4/1963 | Griffiths, Jr. | 239/703 |
| 3,307,789 | 3/1967 | Clark | 239/222.11 |
| 4,011,993 | 3/1977 | Mizund et al. | 239/214 |

OTHER PUBLICATIONS

Cramer et al., *Production of Optically Thin, Free-Standing Oil Films from the Edge of a Rotating Disc*, (Manuscript).

*Primary Examiner*—Alfred E. Smith
*Assistant Examiner*—T. N. Grigsby
*Attorney, Agent, or Firm*—Clifton E. Clouse, Jr.; Roger S. Gaither

[57] ABSTRACT

A thin freestanding oil film is produced in vacuum by directing an oil stream radially inward to the hollow-ground sharp outer edge of a rotating disc. The sides of the edge are roughened somewhat to aid in dispersing oil from the disc. Oil is removed from the surface of disc to prevent formation of oil droplets which might spin off the disc and disrupt the oil film. An ion beam is directed through the thin oil film so that electrons are stripped from the ions to increase their charge.

12 Claims, 5 Drawing Figures

LIQUID-FILM ELECTRON STRIPPER

The United States Government has rights in the invention pursuant to Contract No. W-7405-ENG-48 between the U.S. Department of Energy and the University of California.

BACKGROUND OF THE INVENTION

1. Field of the Invention

This invention relates to liquid films and, more particularly, to a method and apparatus for generating a thin, freestanding liquid film which, in one application serves as an electron stripper for an ion beam.

2. Prior Art

Thin oil films have potential applications as electron strippers in heavy ion accelerators where high charge states are desired. An electron stripper is a device which removes additional electrons from an ion to increase the charge of the ion.

Previously, two techniques for electron stripping have been available, depending on the ion velocity. In one technique, called gas stripping, an ion beam is passed through an electron stripping gas or vapor. For example, the Super HILAC Linear Accelerator at the Lawrence Berkeley Laboratory uses a flourocarbon oil as the stripping medium vapor for 113 keV/A ions injected by the ABEL high intensity injector. In another technique, a higher energy ion beam is passed through a thin carbon foil. For example, in the same Super HILAC Linear Accelerator, a 35 microgram/cm$^2$ carbon foil is used for ions accelerated to 1.1999 MeV/A. The carbon film technique produces higher charge states than does the gas stripping technique but the carbon films have limited lifetimes. For an average current beam of one microampere of $Ar^{40}$, the lifetime of a carbon foil is one hour. With the use of higher ion currents and higher mass ions, that is, with atomic weight A between 100 and 238, now available, the lifetimes of carbon foils are considerably less, possibly less than one minute. Longer lived carbon foils, which have been produced by better carbon disposition methods, are available but they are difficult to produce and expensive.

A third technique which had the potential to solve the short lifetime problem of the carbon foils was suggested by Cramer et al in an unpublished article submitted Sept. 23, 1980 to Nuclear Instruments and Methods entitled "Production of Optically Thin Free-Standing Oil Films from the Edge of a Rotating Disc". In the Cramer et al article, a sharp-edged rotating disc touches the surface of an oil reservoir and spins a thin film from the edge of the disc. Longterm, stable operation was not achieved because the oil level in the reservoir changed so that equilbrium was not achieved. Vibrations also degraded the stability of the film and reproducibility apparently was a problem. The area of the thin film was limited and could be a problem in linear accelerators of the Super HILAC type where the ion beam wanders perhaps as much as a centimeter from a nominal beamline axis.

SUMMARY OF THE INVENTION

It is therefore an object of the invention to provide an economical, long-lived, self-regenerating means for stripping additional electrons from ionized particles.

It is another object of the invention to provide a large-area, thin oil film.

It is another object of the invention to provide a vacuum-compatible thin liquid film generator.

Additional objects, advantages and novel features of the invention are set forth in part in the description which follows, and in part will be apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, this invention includes a method and apparatus for producing a thin, freestanding liquid film. A rotating member, such as a disc, has a sharp, radially-extending outer edge from which a liquid, such as oil, is spun. The side of the edge is roughened to aid in dispersion of the liquid into the thin film as the rotating member turns. A stream of liquid is directed tangentially toward the edge of the rotating member by a liquid-directing means, which includes, for example, a nozzle and a pump for the liquid. Preferably a fluid reservoir is used to provide a recirculating fluid supply. The stream of liquid has an inwardly-directed velocity component so that liquid is spun from the rotating mmber to form a thin, freestanding film. Preferably excess liquid is removed from the disc, or rotating member, to prevent formation of liquid droplets on the disc which might spin off and disrupt the film. In a further aspect of the invention the rotating member, or disc, is mounted in a vacuum chamber and a particle beam is directed through the film so that electrons are stripped from the particles. Ionized particles will thereby have their ionization further increased. The invention provides an economical, easily reproduced technique for generating stable, large-area, thin films well suited for electron stripping of heavier ions.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE PREFERRED EMBODIMENT

Reference is now made in detail to the present preferred embodiment of the invention which illustrates the best mode presently contemplated by the inventors of practicing the method and apparatus of the invention, an example of which is illustrated in the accompanying drawings.

Figure 1:
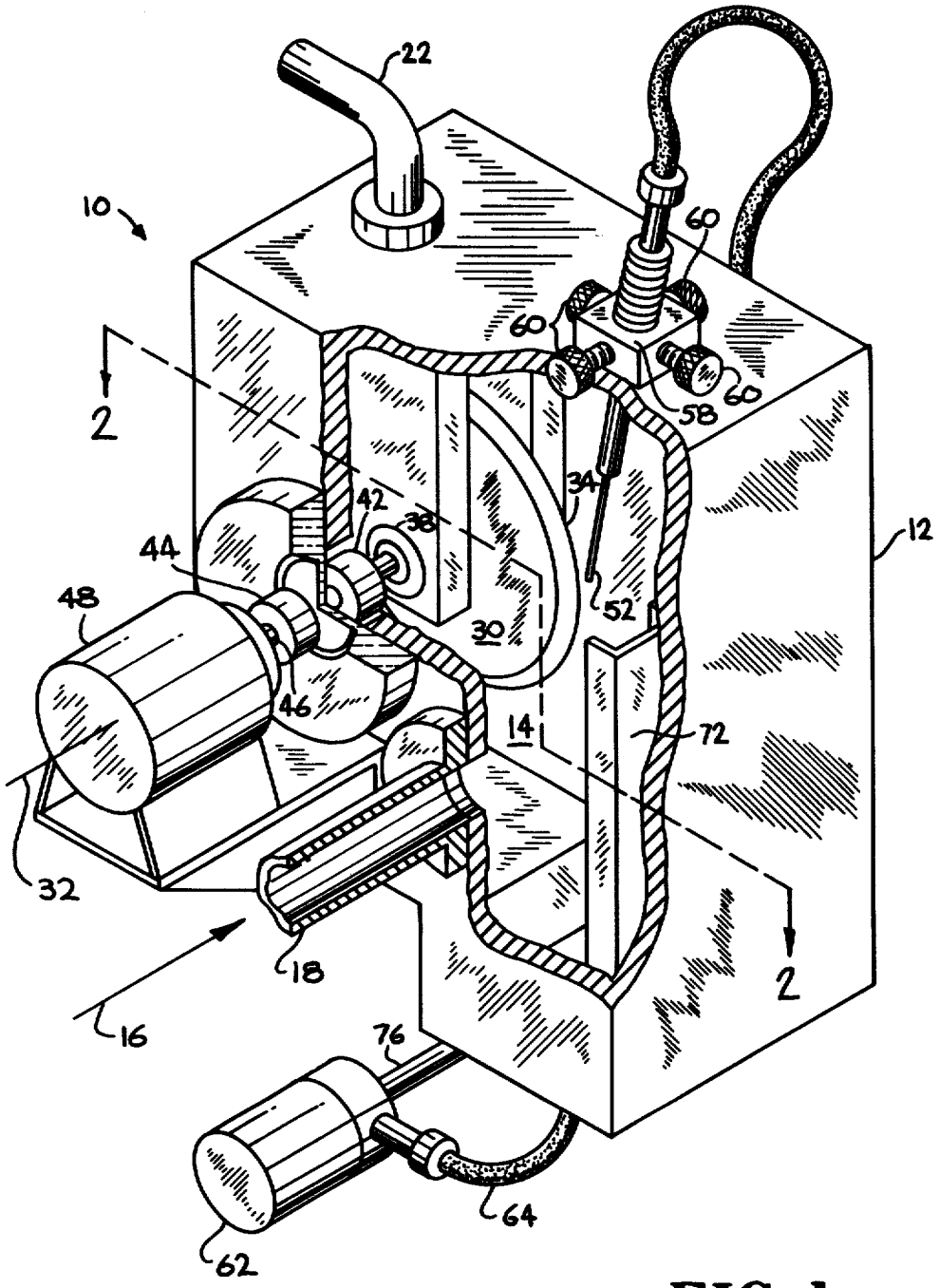
FIG. 1 is an isometric, partially sectional view of apparatus according to the invention.
Figure 2:
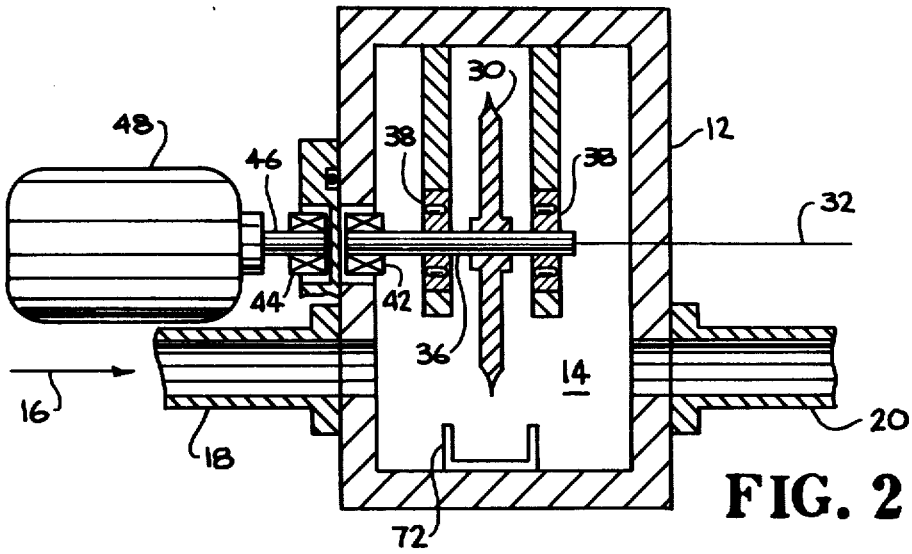
FIG. 2 is a partially sectional view taken along, section line 2—2 of FIG. 1.

Referring to FIG. 1 of the drawings, apparatus for generating a thin oil film according to the invention is shown with a specific application as an electron stripper for high-intensity heavier ion beams. It should be appreciated that thin liquid films are useful for other applications. A thin liquid film generator assembly 10 is shown having a vacuum-tight housing 12 which has a vacuum chamber 14 formed therein. A particle beam, such as a beam of high intensity heavier ions, from an ion source (not shown) travels through the vacuum chamber 14 along the direction indicated by the beam direction line 16. An input spool 18 and an output spool 20, respectively fastened to the housing 12 as shown in FIG. 2, are easily connected into the ion beamline of a linear accelerator, such as the Lawrence Berkeley Laboratory Super HILAC, which provides a means for directing a beam of particles into and away from the housing 12. The vacuum within the housing 12 is provided through the spools 18, 20 by beam line vacuum system. Differential vacuum pumping is also provided to the housing 12 through a vacuum port and line 22.

A key element for forming a thin liquid film 28 in accordance with the invention is a rotating member, in this case, a disc 30 mounted as shown in FIGS. 1 and 2 for rotation about an axis 32.

Figure 3:
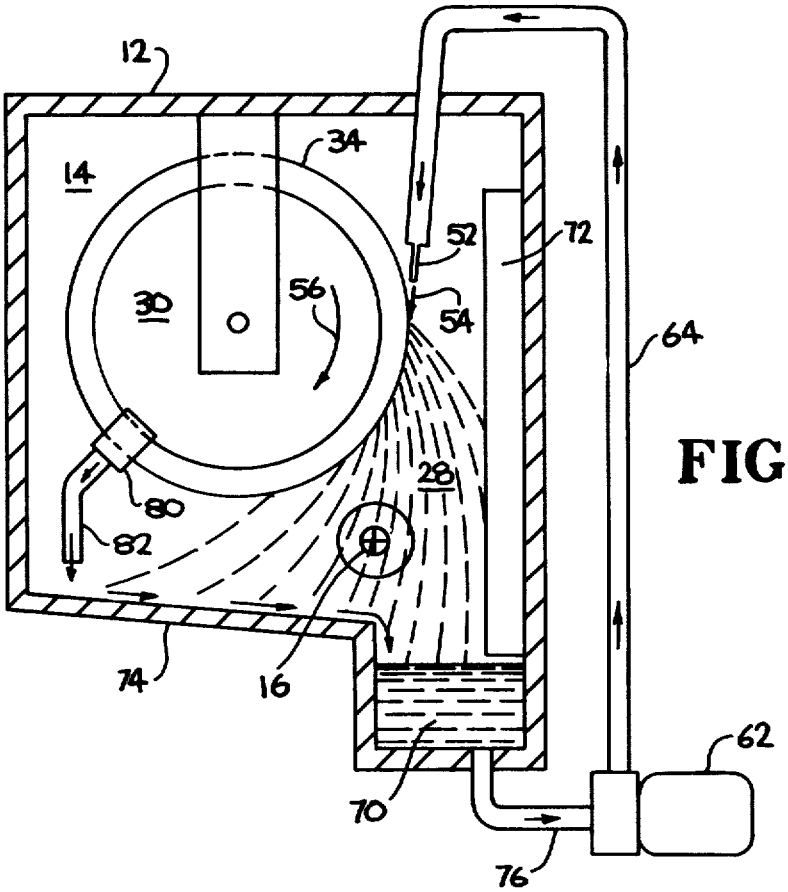
FIG. 3 is a diagrammatic view showing operation of the invention.
Figure 4:
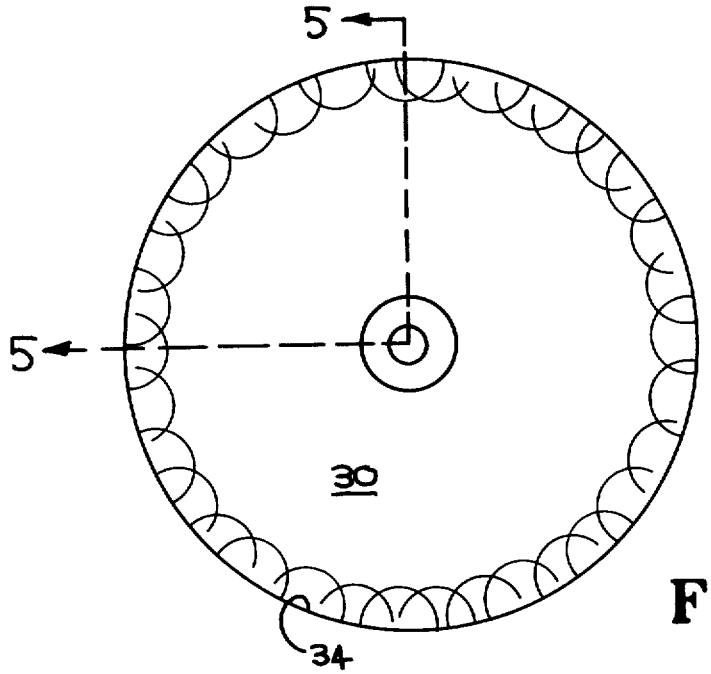
FIG. 4 is a side view of a sharp-edged rotating member, or disc, according to the invention.
Figure 5:
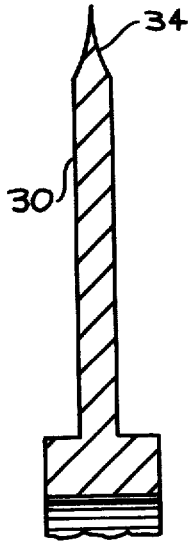
FIG. 5 is a sectional view of a disc taken along section line 5—5 of FIG. 4.

Referring to FIGS. 4 and 5, the disc 30 is made of tool steel and has a 9 cm. diameter. The outer edge is precision hollow-ground into a sharp, radially-extending edge. The edge is nick-free and the sides of the edge are roughened slightly with a stone to provide a roughened surface finish, which provides frictional force between the liquid and the disc to aid in dispersing liquid spun from the rotating edge forming the film 28 as indicated in FIG. 3.

FIG. 2 shows the disc fixed to a shaft 36 which rotatably mounts the disc within the vacuum chamber 14. A pair of roller bearing assemblies 38 located on opposite sides of the disc and mounted to the housing 12 serve as bearings for the rotating disc 30 in order to minimize vibration and avoid disruption to the thin film 40 spun from the disc. To further minimize vibration, the shaft 36 is driven at one end by a magnetic clutch assembly 40. A driven magnet 42 is mounted on the one end of the shaft 36 inside the vacuum chamber 14. A driven magnet 44, located outside the vacuum chamber 14, is mounted to the output shaft 46 of a variable-speed disc-driven motor 48. The motor 48 speed is varied to optimize the film 28 characteristics as desired. The disc is precision ground and rotatably mounted and driven as described so that the disc runs very straight and true to avoid modulation and unevenness in the liquid film.

FIG. 3 shows in diagrammatic form the operation of the apparatus according to the invention. A nozzle 52 in this embodiment serves as a means for directing a stream of liquid, represented by the arrow 54 in FIG. 3 at the sharp edge 34 of the disc 30 which rotates in the direction of arrow 56, as shown. The nozzle 52 has a diameter of 1.5 mm. and is positioned by a nozzle adjustment assembly 58 shown in FIG. 1 having four nozzle adjustment screws 60. A fine stream of liquid, in this case an oil described below, flows downward to tangentially touch the sharp edge 34 of the rotating disc 30. The liquid has an inward radial velocity component so that liquid impinging on the edge is spun therefrom to form the thin freestanding liquid film 40. It has been found that an axial fluid component improves the film area somewhat, but is not essential. As previously mentioned, the roughened sides of the edge provide some frictional drag so that some liquid stays with the disc before it is spun off, making a large area film. A liquid pump 62 pumps fluid through a conduit 64 to the nozzle 52. To avoid instabilities in the film caused by fluid pressure modulation in the vacuum, the pump 62 is a completely enclosed, vacuum tight centrifugal pump.

FIG. 3 diagrammatically shows a recirculating liquid supply for the fluid which includes a liquid reservoir 70 formed in the lower part of the housing 12. Liquid forming a film spins from the rotating disc 30 with some of it hitting an oil channel, splash-guard member 72 and part of the bottom 74 of the housing 12, from which the liquid flows into the reservoir 70. Fluid is fed from the reservoir 70 through another conduit 76 to the input of the pump 62 to complete the recirculation path.

FIG. 3 shows an embodiment of a means for removing excess liquid from the rotating disc 30 to prevent formation of liquid droplets which might travel around the disc and spin off to disrupt the oil film 40. A brush member is formed from flexible tubing having a slit formed therein through which the edge 34 of the disc passes. The flexible tubing lightly contacts the disc and guides the excess liquid into a pipe 82 which returns the excess liquid to the reservoir 70.

Films were produced by the apparatus described above using a multipurpose oil, Dow Corning 200 (DC200), having a viscosity of 50 cs. Stable films were produced having areas of 30 $cm^2$ with densities of 30 micrograms/$cm^2$±20%.

One measurement of the film thickness was made by exposing the film to white light, which showed an interference pattern characteristic of a thin wedge. A sequence of colored bands caused by destructive interference of a particular wavelength λ is given by equation (1):

$$d = m\frac{\lambda/2}{\sqrt{n^2 - \sin^2 a}}\ ;\ m = 0, 1, 2 \ldots \qquad (1)$$

where d=local film thickness
m=order of interference
n=index of refraction
a=angle of observation Table 1 lists the sequence of color bands observed under 45° for DC 200 oil (n≅1.4) and 2000 RPM. With increasing thickness the color appearance changes gradually since the condition for destructive interference given by eq. (1) can be satisfied simultaneously by an increasing number of different wavelengths for different orders m. The fourth column shows the local areal density based on eq. (1) density of 0.96 g/$cm^3$.

TABLE 1

TYPICAL SEQUENCE OF COLOR BANDS FOUND IN DC 200 THIN FILM INTERFERENCE PATTERN

| Color Apperance | Destructive Interference For | Interference Order m | Thickness Based on Equation 1 | Thickness Based on Alpha-Energy Loss |
|---|---|---|---|---|
| dark | — | m = 0 | [micro gm/$cm^2$] | [micro gm/$cm^2$] |
| yellow-orange | violet-blue | m = 1 | 16-18 | 28 |
| red-purple | green-yellow | | 21-23 | |

TABLE 1-continued

TYPICAL SEQUENCE OF COLOR BANDS FOUND IN DC 200 THIN FILM INTERFERENCE PATTERN

| Color Apperance | Destructive Interference For | Interference Order m | Thickness Based on Equation 1 | Thickness Based on Alpha-Energy Loss |
|---|---|---|---|---|
| blue | orange-red | | 24–28 | |
| yellow | violet-blue | m = 2 | 32–36 | 36 |
| red-purple | green-yellow | | 42–46 | |
| blue | orange-red | | 48–56 | |
| green-yellow | violet-blue | m = 3 | 48–54 | 80 |
| red | green | | 63–69 | |
| green | red | | 72–84 | |
| orange-red | blue-green | m = 4 | 72–88 | 88 |
| green | red | | 96–112 | |

Another measurement of the film was made using 8.8 MeV alpha-particle from a $Po^{212}$ source and a silicon surface-barrier detector to determine film thickness from alpha-particles dE/dx measurements. The results of those measurements are listed in column 5 of Table 1. The overall error of these measurements is estimated at 15% due to source-detector alignment uncertainty.

The vapor pressure of the DC 200 oil is $3\times10^{-2}$ torr at room temperature. This requires the use of a differentially pumped vacuum system for electron strippers used in linear particle accelerators, such as the Super HILAC system.

To achieve stable, freestanding thin films of the type described above, that is, 30 $cm^2$ area and 30 micrograms/$cm^2$, it has been found that attention must be paid to items such as providing a rotating disc which runs true and has the roughened surfaces adjacent the edge. The oil stream should hit the disc with an inward radial velocity component. Removal of excess liquid from the disc to prevent film breakup is also important. It should be apparent that the invention described above provides means for achieving these items.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. Apparatus for producing a thin, freestanding liquid film, comprising:

a rotating member mounted for rotation about an axis, said member having an outer edge portion formed into a sharp, radially-extending edge with the side of said edge being roughened to aid in dispersion of liquid from the member when it rotates; and liquid-directing means for directing a stream of liquid at the outer edge of said rotating member such that said liquid has an inward radial velocity component with the liquid impinging upon the outer edge of said rotating member being spun therefrom to form a thin freestanding liquid film.

2. The apparatus of claim 1, including means for removing excess liquid from the rotating member to prevent formation of liquid droplets which might spin off to disrupt the thin liquid film.

3. The apparatus of claim 1 wherein the rotating member is a disc having a hollow-ground sharp edge formed thereon with the sides of the sharp edge being roughened.

4. The apparatus of claim 1 wherein the liquid is oil and wherein the rotating member and the liquid-directing means are mounted in a vacuum chamber, and including means for directing a beam of particles through the thin oil film so that electrons are stripped from the particles by collisions with liquid film.

5. The apparatus of claim 1 wherein the liquid-directing means includes a nozzle and liquid pumping means.

6. The apparatus of claim 1 including a fluid reservoir into which fluid flows after having been directed to the rotating member and from which reservoir fluid is taken by the fluid-directing means to provide a recirculating fluid supply.

7. A liquid-film electron stripper for generating a thin, freestanding film of oil through which a beam of high intensity ions passes, comprising:

a housing having a vacuum chamber formed therein and through which the beam of high intensity ions passes;

a disc rotatably mounted within the vacuum chamber for rotation about an axis, said disc having a radially-extending sharp outer edge with portions adjacent said edge having roughened surfaces to aid in dispersion of liquid from the rotating disc;

means for directing a stream of oil at the sharp outer edge of the disc such that the oil impinges on the sharp outer edge with an inward radial velocity component so that oil is spun from the disc to form a thin oil film through which the beam of high intensity ions pass to be stripped of additional electrons; and means for removing oil from the surface of the disc to prevent formation of oil droplets on the disc and disruption of the thin oil film.

8. A method of producing a thin freestanding liquid film in an evacuated vacuum chamber, comprising the steps of:

rotating a rotably mounted member on its axis, said member having an outer edge shaped to form a sharp, radially-extending edge with the sides of said edge being roughened to aid in dispersion of liquid;

directing a stream of liquid at the outer edge of the rotating disc, said stream of liquid having an inwardly-directed radial velocity component so that liquid spun from the rotating member forms a thin freestanding liquid film.

9. The method of claim 8 including the step of removing excess liquid from the rotating member to prevent formation of liquid droplets which might spin off the disc and disrupt the thin liquid film.

10. The method of claim 8 wherein the step of directing a stream of liquid at the outer edge of the rotating member includes the step of pumping the liquid through a nozzle directed at the edge of the rotating member.

11. The method of claim 8 including the steps of collecting liquid in a reservoir and recirculating said collected liquid to be again directed at the outer edge of the rotating member.

12. The method of claim 8 wherein the liquid is oil and including the step of directing a beam of particles through an oil film formed in a vacuum chamber so that electrons are stripped from the particles by collisions with the oil film.

* * * * *